United States Patent [19]

Edgar et al.

[11] Patent Number: 4,864,957

[45] Date of Patent: Sep. 12, 1989

[54] APPARATUS AND METHOD FOR LAUNCH AND RECOVERY OF WATERCRAFT ONTO AND FROM THE DECK OF A HOST VESSEL

[75] Inventors: Jack K. Edgar; Chandru M. Kalro; both of Alexandria, Va.

[73] Assignee: Diversified Technologies, Inc., Alexandria, Va.

[21] Appl. No.: 274,315

[22] Filed: Nov. 21, 1988

[51] Int. Cl.[4] ..... B63B 39/02

[52] U.S. Cl. ..... 114/258; 414/137.7; 114/125; 405/209

[58] Field of Search ..... 114/121, 34, 124, 28, 114/264, 29, 265, 258–260, 44, 45, 27, 31, 32; 414/137.2, 137.7, 137.8, 137.9; 14/1, 73; 405/196, 205, 209

[56] References Cited

U.S. PATENT DOCUMENTS

| | | | |
|---|---|---|---|
| 3,993,011 | 11/1976 | Garland | 414/137.7 |
| 4,345,536 | 8/1982 | Gregg | 114/260 |
| 4,683,832 | 8/1987 | Dysarz | 405/209 |

*Primary Examiner*—Joseph F. Peters, Jr.

*Assistant Examiner*—Edwin L. Swinehart

*Attorney, Agent, or Firm*—Mason, Fenwick & Lawrence

[57] ABSTRACT

Apparatus for recovery and launch of secondary watercraft such as SALM bases, barges and the like onto and from the deck of a host ship, comprising a pair of elongated inclined skid beam assemblies extending transversely across the host ship defining a pair of parallel skid paths spaced apart longitudinally of the ship, each skid beam assembly comprising a stationary skid beam section and a hinged skid beam section. The stationary skid beam section has a substantially rectilinear skid surface spanning a major portion of the width of the ship's deck and extending in an inclined plane relative to the deck defining a wedge-like skid formation converging toward a side of the vessel for slidably supporting the secondary watercraft during launch and recovery thereof. A hinge block supports the hinged beam at an end of its associated stationary skid beam section adjacent a lateral margin of the deck for swivel movement about a pivot axis lying in a vertical transverse plane and extending perpendicular to the inclined plane of the skid surfaces of the stationary and hinged beam sections.

17 Claims, 6 Drawing Sheets

APPARATUS AND METHOD FOR LAUNCH AND RECOVERY OF WATERCRAFT ONTO AND FROM THE DECK OF A HOST VESSEL

BACKGROUND AND OBJECTS OF THE INVENTION

The present invention relates in general to a method and apparatus for recovery and launch of marine structures onto and from the deck of ships, and more particularly to methods and apparatus for recovery and launching of barges, barge-like craft, Single Anchor Leg Mooring (SALM) bases, ships, boats, small craft and other marine structures onto and from the deck of host ships, such as cargo ships, tank ships and barges, in a timely controlled and safe manner, relevant to the areas of marine construction, off shore oil development, marine transportation, salvage, and military and commercial rapid deployment and rapid logistics support.

Heretofore, the primary methods for launching and recovery of marine structures such as SALM bases, barges and similar craft and the like, have involved the use of wet or floodable wells, such as floating drydock structures, or the use of support devices such booms, davits, cranes, beam climbers, and articulating structures. More recently, wedge shaped beams have been employed to launch and recover a SALM base, but such wedge shaped beam structures were pivoted at one side of the ship and were raised and lowered at the other side of the ship using a goal post type of structure. The wedged beams extended on beam climbers to the waters edge, and another set of beam climbers walked in and out on the upper wedge beam to effect recovery and launch of the SALM base.

These earlier methods of launching and recovery of marine craft required equipment with large capacities, in the case of booms, cranes, davits and like structures, to effect a recovery or launch. The well or wet deck type of structure required a significant modification of the host ships hull, using a significant amount of volume that could otherwise be devoted to cargo. The wedge shaped beam structures pivoted at one side of the ship for raising and lowering, to launch and recover a SALM base, requires a heavy structure, a large number of hydraulic controls, hoses and fixtures, and a large amount of time is consumed in performing the launch and recovery operations. Also such structures have demonstrated a tendency to launch the SALM base or barge unexpectedly.

An object of the present invention is the provision of a novel launch and recovery system and method for launching and recovering water craft from and onto the deck of a host ship or the like, which is simple in both fabrication and construction, and is flexible in that it can be installed on a wide variety of hull forms and incorporate a number of optional and diverse configurations, and is capable of being powered by a variety of different power sources. In one form of the invention, a hinged beam launch and recovery system is provided which can be installed taking advantage of the existing ship's structure and operating systems. The beam and supporting structure of this launch and recovery system is fabricated of common shapes and materials in lesser quantities than other systems, and involves less weight and lower fabrication and installment costs. The beam angle is adjustable during installation to accommodate the hydrostatic and operational characteristics of the ship. The hinged beams are configured to swing inboard about an axis perpendicular to the inclined plane defined by the craft supporting and guiding inclined surfaces of the stationary wedge beam sections and the hinged beams forming an outboard continuation of that inclined plane. The beam structures are configured to minimize the loss of cargo volume while maintaining hull girder strength.

The hinged beam configuration of the launch and recovery system is provided which permits diverse arrangements of the hinged beam, hinged block, deployment method, and securing mechanisms. The hinge beam may be swung or deployed in several ways, using gravity, block and tackle, hydraulic cylinders, gearing or other methods. This flexibility permits taking advantage of the ship's existing outfitting, and securing of the hinged beam may be by pin, bolt, latch, detent, welding or other known methods or combinations of methods. The hinged beam configurations of the present invention does not require heavy pivot blocks at "goal posts" or other beam lifting devices. This enables the load of both the launch and recovery structure and the recovered craft to be evenly distributed as opposed to being concentrated. In a preferred form of the system, the beams are fitted with low friction material, and when thus fitted, provide particular advantage on a tank ship or other ship where heat and spark generation needs to be avoided.

The system of the present invention may be described generally as a system to launch and recover marine vessels, herein sometime referred to as a secondary water craft or recovered vessel, brought onto the deck of a mother vessel or host craft. The secondary craft or recovered vessel is connected to a trolley assembly by a suitable connection mechanism, and the trolley assembly is free to slide up and down a skid beam, which has a liner which serves to reduce the friction between the trolley and the skid beam, and between the recovered vessels bottom and the skid beam. The trolley is pulled up the skid beam by means of a rope or cable attached at one end to the trolley and at the other end to a pulling assembly, which may consist of linear pullers, winches, and other known pulling devices, and such rigging as may be needed. The skid beams provide as surface to support the recovered vessel when the mother vessel or host craft is in transit, and also provide a continuous inclined surface extending to below the water line to allow the launch and retrieval of the recovered vessel. The skid beams include a stationary or fixed skid beam section and a movable skid beam section extended out beyond the side shell of the host craft in the form of hinged beams connected to each respective fixed skid beam, which hinge out about the generally vertical hinge axis perpendicular to the fixed skid beam surface. By inclining the ship, the outboard ends of the extended skid beams can be lowered below the water level.

Other objects, advantages and capabilities of the present invention will become apparent from the following detailed description, taken in conjunction with the accompanying drawings illustrating preferred embodiments of the invention.

DETAILED DESCRIPTION OF A PREFERRED EMBODIMENT

Figure 1:
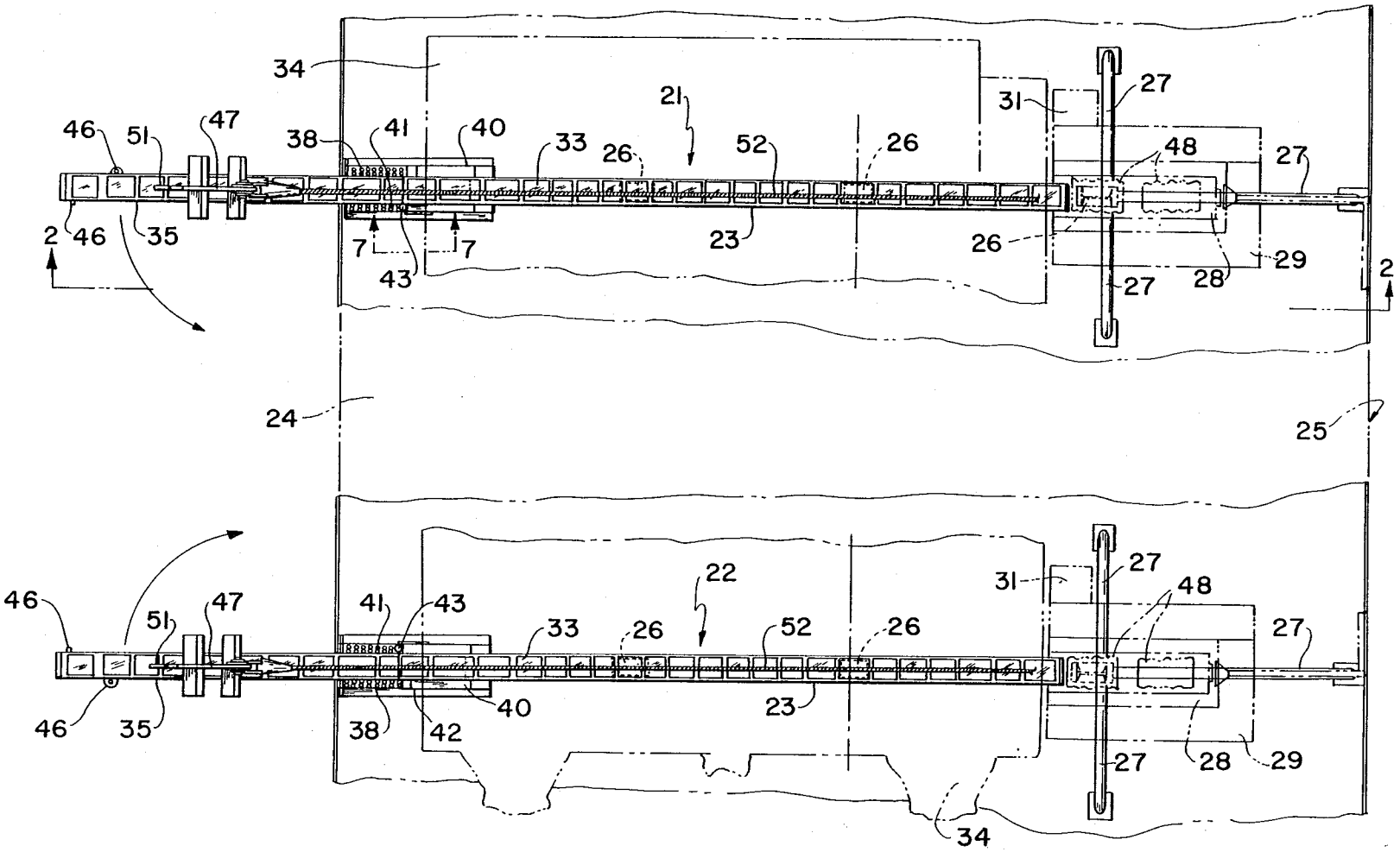
FIG. 1 is a top plan view, including a fragmentary illustration of a mother vessel or host craft and a broken line illustration of a secondary craft or recovered vessel, showing the two skid beam assemblies of the launch and recovery system of the present invention in extended position.
Figure 2:
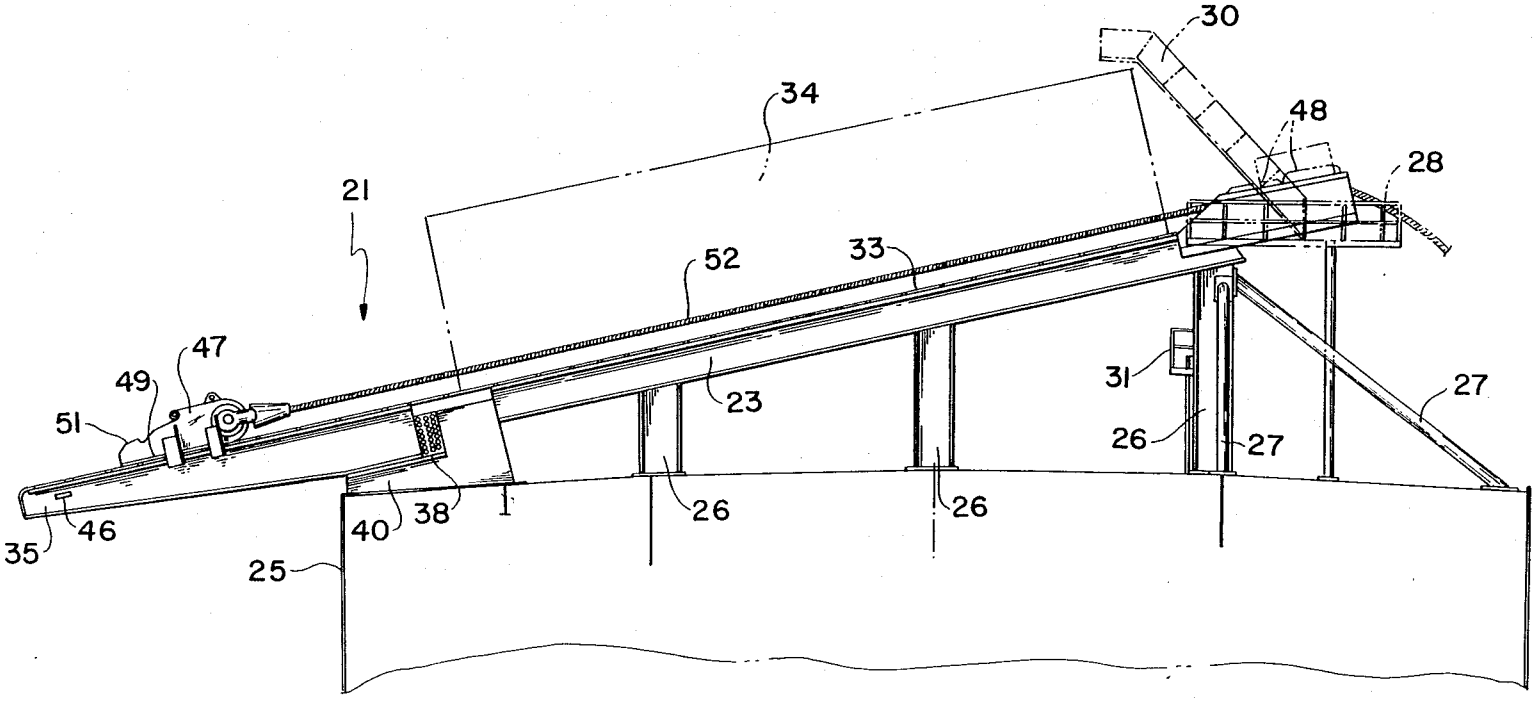
FIG. 2 is a side elevational view of the launch and recovery system beam structure and associated components, with portions of the mother vessel or host ship shown in section, taken along the section plane 2—2 of FIG. 1.
Figure 3:
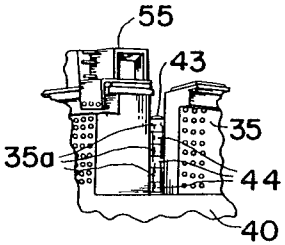
FIG. 3 is a detailed section view of the hinge structure for the hinged skid beam component with the hinged beam in inboard position, taken along the line 3—3 of FIG. 2.
Figure 4:
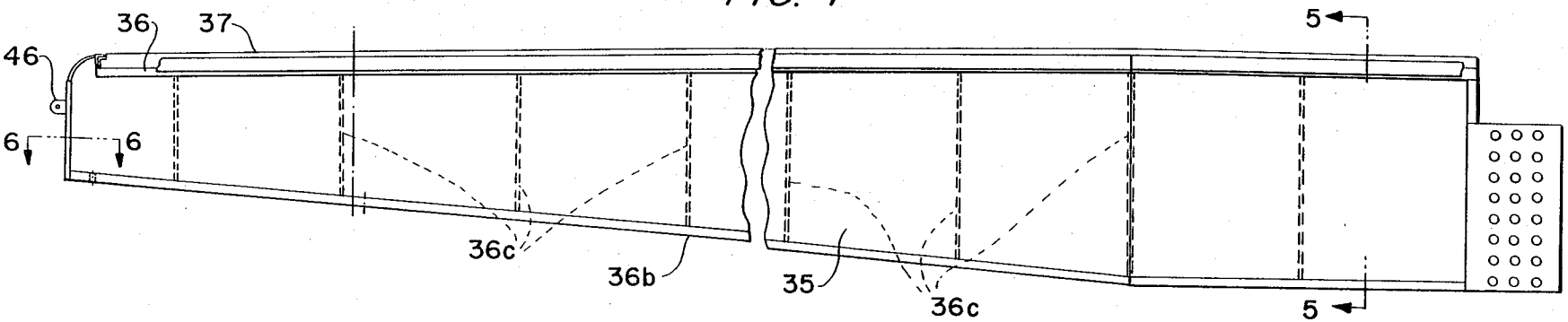
FIG. 4 is an enlarged side elevational view of the hinge beam component of one of the skid beam assemblies for supporting and guiding the SALM base.

Referring to the drawings, wherein like reference characters designate corresponding parts throughout the several figures, the launch and recovery system and structure of the present invention is indicated generally by the reference character 20, and comprises two skid beam assemblies, indicated at 21 and 22, spaced for example about 100 feet apart, with the forward beam 22 being, in effect, the mirror image of the aft beam 21, except for the ladder and catwalk platform. Only the aft skid beam assembly 21 will be described in detail, as the structure of the forward skid beam assembly 22 will be well understood from that description. Referring particularly to FIGS. 1 and 2 showing the general assembly of components making up the skid beam assemblies 21 and 22, a fixed or stationary skid beam 23 is provided, carried in an inclined plane above the deck 24 of the ship hull 25 by vertically extending fixed skid beam support columns 26, which are generally similar in construction but of different heights, and a supporting brace framework 27 coacting with the highest support column 26 to support the highest end of the fixed skid beam 23. A linear winch platform 28, a catwalk platform 29 and a SALM base access ladder 30 are supported adjacent the uppermost end of the fixed skid beam section 23. An intermediate platform 31 is also provided on the tallest fixed skid beam support column 26. The skid beams 23 of the two skid beam assemblies 21, 22 are preferably provided with NYLATRON ® friction reducing pads, indicated at 33, along their uppermost surface to reduce the friction of the SALM base indicated at 34.

Extending outboard along the projected path or plane of each fixed skid beam 23 is a hinged skid beam 35 which opens out as an extension to the associated fixed beam 23. This extension, along with the inclination of the host vessel, provides a bearing surface for the SALM base 34 to slide down into the water until it floats and also allows a trolley hook assembly to retrieve the floating SALM base.

Figure 6A:
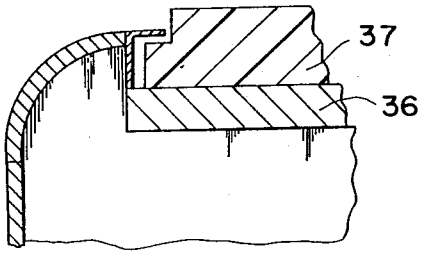
FIG. 6A is a fragmentary vertical section view taken along line 6A—6A of FIG. 6.
Figure 6:
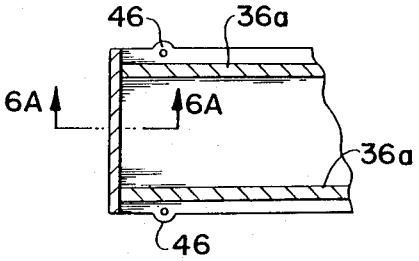
FIG. 6 is a fragmentary horizontal section view through the end portion of the hinge beam, taken along the line 6—6 of FIG. 4.
Figure 5:
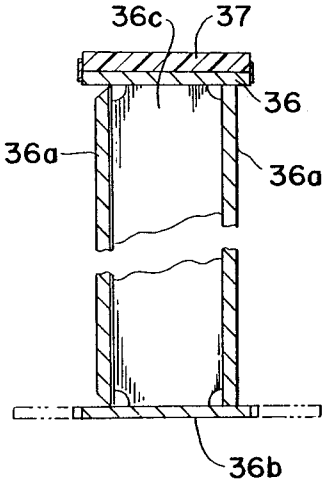
FIG. 5 is a vertical transverse cross-section of the beam, taken along the line 5—5 of FIG. 4.
Figure 7:
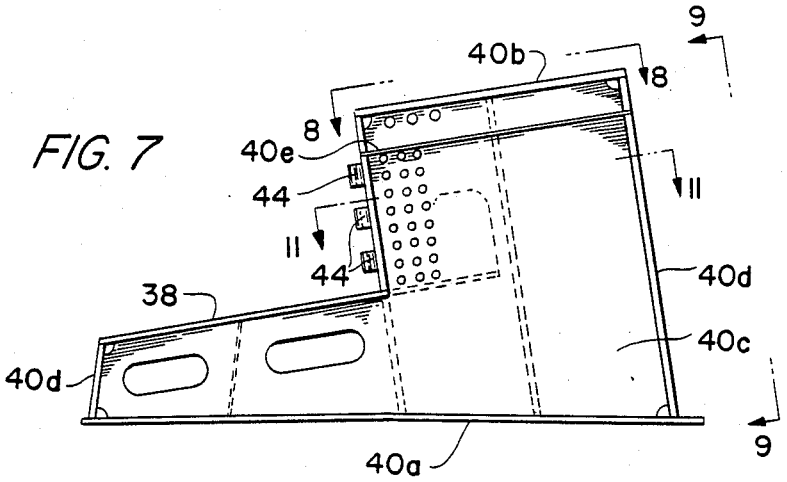
FIG. 7 is an enlarged fragmentary side elevation of the hinge block structure for the aft skid beam assembly, viewed from the plane indicated at 7—7 in FIG. 1.
Figure 8:
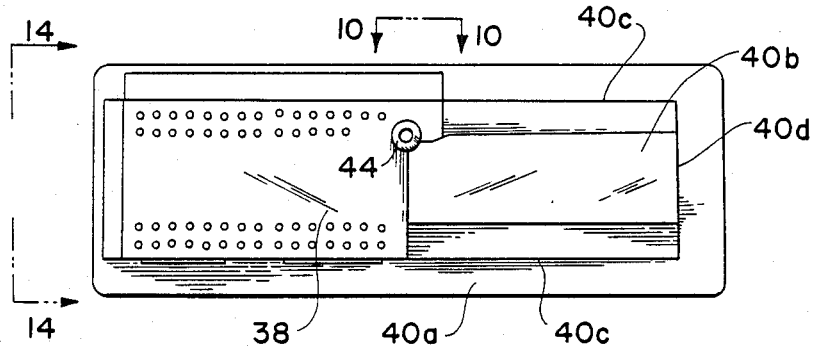
FIG. 8 is a top projection view of the hinge block structure, viewed from the plane 8—8 of FIG. 7.
Figure 9:
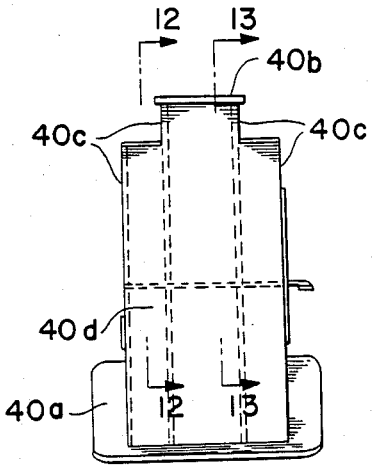
FIG. 9 is an end projection view of the hinge block, viewed from the plane 9—9 of FIG. 7.
Figure 10:
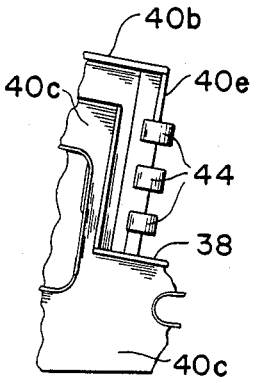
FIG. 10 is a fragmentary elevational view showing details of the hinge structure, viewed from the plane 10—10 of FIG. 8.
Figure 11:
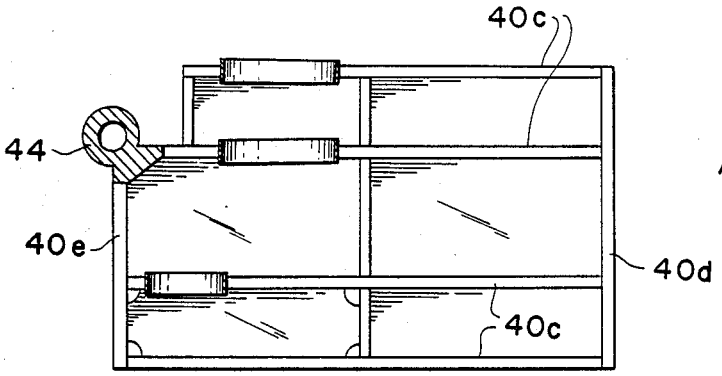
FIG. 11 is a section view through a portion of the hinge block, taken along line 11—11 of FIG. 7.
Figure 12:
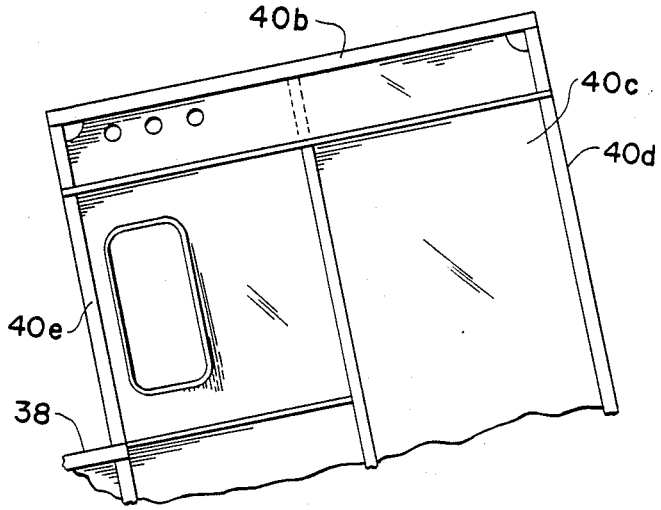
FIGS. 12 and 13 are vertical section views through the hinge block, taken along lines 12—12, and 13—13 of FIG. 9.
Figure 13:
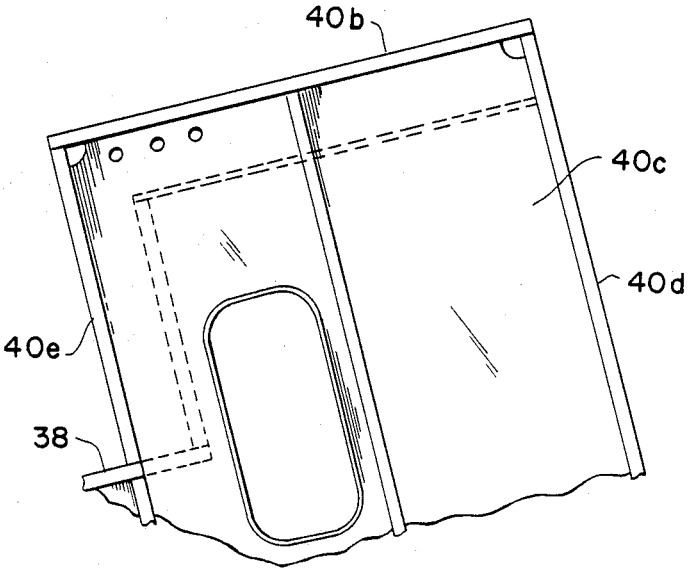
Figure 14:
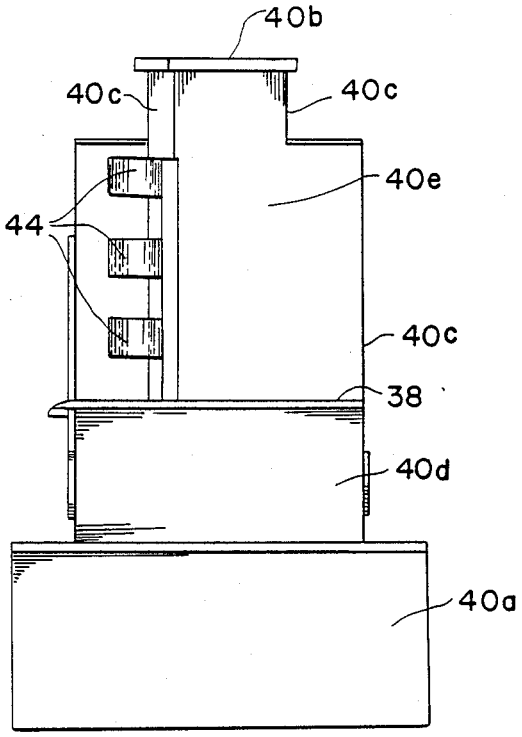
FIG. 14 is an end view of the hinge block, taken along line 14—14 of FIG. 8.

The hinged skid beam assembly 35 includes an upper plate 36 carrying a NYLATRON ® friction reducing liner 37, and is of a box beam structure, as well be seen from inspection of FIGS. 5 and 6, formed of side plates **36*a*, bottom plate 36*b* and vertical interior plates 36*c*. A hinged beam bed plate 38 providing a means to bolt the hinge beam 35 to a hinge block 40 and to transfer the loads to the hinge block 40 using retainer bolts 41. Side plate bolts 42 are provided as a means of attaching the hinged skid beam 35 to the hinge block 40 to transfer loads from the hinged beam 35 to the hinge block 40. The hinge block 40 in the preferred embodiment is of the construction shown in FIGS. 7–14, and is formed of welded and bolted bottom plate 40*a*, top plate 40*b*, vertical side plates 40*c*, upwardly inclined outer and inner end plates 40*d* and intermediate plate 40*e*, and hinge castings 44, located as shown to provide appropriate support for the hinged skid beams 35 and SALM base 34 carried thereby under the severe load conditions when the skid beams 35 are in the outboard position and the SALM 34 is located outward along the hinged beams. The hinge block 40 provides a means of attachment for the hinged skid beam 35 and to transfer loads from the skid beams to the deck of the ship 25**.

Hinge pin 43, extending through hinge block hinge castings 44 and hinged beam hinge pintles **35*a* allow the hinged beam 35 to swivel about the hinge pin 43 when not in use as a skid beam extension. The fixed skid beams 23 provide support for the SALM base 34 during haul in, launch or in transit, and also provide a surface for a trolley assembly to ride on. Preferably they are marked to indicate the distance from the outboard tip of the hinged skid beams 35**.

It will be noted from the drawing that padeyes, as indicated at 46, are provided at the outermost tip and adjacent the outer end of each hinged skid beam 35. These are provided to permit a snatch block to be attached to an appropriate padeye and be rigged up to pull a trolley assembly, as indicated at 47, down the skid beam assembly and alternatively such rigging is used to open the hinged skid beam 35 to outboard extended position and to pull in the hinged skid beam to inboard position, as required.

The linear puller platform 28 support hydraulically powered linear pullers 48. The catwalk platform 29 provides access to these linear pullers 48 and serves as a base for the SALM access ladder 29 which provides access to the top of the SALM base 34 when it is supported in raised position on the fixed skid beams 23. Trolley pads 49 are attached to the arm of the trolley assembly 47 and are used to transfer side loads from the trolley 47 to the skid beams, and also to keep low the friction arising from this contact. A hook 51 forming part of the trolley assembly 47 serves as a connection between the SALM base 34 and the trolley so that when the trolleys 47 for the two skid beams 21, 22 are hauled up the skid beams, the SALM base 34 is hauled up, and the SALM 34 is lowered into the water when the trolleys 47 are lowered along the skid beams. Suitable connecting means such as a wire rop 52 connects the trolley assembly 50 to the associated hydraulically powered linear puller 48 to communicate the motive force from the pullers to the trolley assemblies.

Preferably, the ship 25 carrying the skid beam launch and retrieval system is also equipped with a heeling systems which is used to heel the ship in a controlled manner, to facilitate the launch and retrieval of the SALM base 34. To accomplish this, heeling tanks are provided in the ship to contain ballast liquids, transfer of which produces the list in the ship. Heeling pumps, transfer the ballast from one heeling tank to another through a suitable piping system to produce the list. The heeling pump controls are preferably mounted close to the launch and retrieval system controls which control the linear pullers, both at a convenient location for operation of these two systems. Preferably the controls are designed to provide synchronized operation of the linear pullers. Also, port side transit stops, as indicated at 55 are provided to keep the SALM base in position during transit.

Figure 15:
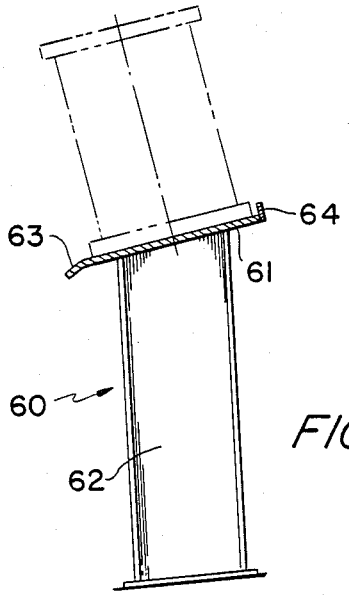
FIG. 15 is a vertical section view through the beam rest, taken along the section plane 11—11 of FIG. 2, with the hinge beam shown in broken lines thereon.
Figure 16:
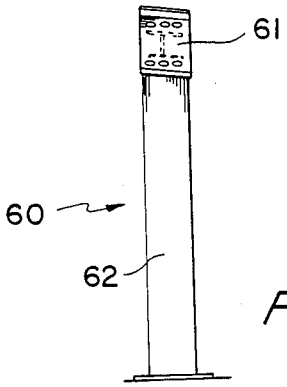
FIG. 16 is an end elevational view of the beam rest assembly, viewed from the left of FIG. 15.

A hinged skid beam rest structure 60 as shown in FIGS. 15 and 16 is provided to lend support to the hinged skid beams 35 when they are stored in the retracted inboard position. Such beam rests 60 in the illustrated embodiment includes an inclined upper bearing plate 61 welded to and supported by an I-beam type post or column member 62 fixed to the deck 24 in any conventional manner. The upper bearing plate 61 may have a downwardly curved lip 63 at the entrance edge thereof to guide the hinged skid beam 35 onto the plate 61 and may have a stop shoulder formation 64 formed by a plate or flange to form abutment for the beam 35 at the proper rest position.

We claim:

1. Apparatus for recovery and launch of secondary watercraft onoto and from the deck of a host vessel, such as recovery and launch of single anchor leg mooring bases, barges and the like, comprising elongated inclined skid beam assemblies extending transversely of a longitudinally axis of the host vessel defining parallel skid paths spaced apart longitudinally of the vessel, each skid beam assembly comprising a stationary skid beam section and a hinged skid beam section, said stationary skid beam section being surmounted above and fixed to an upper deck of the host vessel and having a substantially rectilinear skid surface spanning a major portion of the width of said upper deck and extending in an inclined plane relative to said deck defining a wedge-like skid formation converging downwardly relative to the deck and laterally toward a side of the vessel for slidably supporting a secondary watercraft during launch and recovery thereof, and hinge block means for said hinged beam section supporting the hinged beam section at an end of its associated stationary skid beam section adjacent a lateral margin of said deck for swivel movement about a pivot axis lying in a vertical transverse plane which includes said skid path with said pivot axis maintained perpendicular to said inclined plane, said hinged beam defining an upwardly facing rectilinear skid surface and being movable from an inboard storage position wherein the hinged beam is disposed substantially parallel to the host vessel longitudinal axis to an outboard launch and retrieval position disposed aligned with its associated stationary skid beam section as an aligned extension of its skid path projecting a predetermined distance laterally outboard of the adjacent side of the host vessel.

2. Apparatus for recovery and launch of secondary watercraft relative to a host vessel, as defined in claim 1, wherein said hinged beam section of each skid beam assembly is of a length adequate to locate the outer tip portion thereof, at the end of the hinged beam opposite said pivot axis substantially at or below the adjacent water level.

3. Apparatus for recovery and launch of secondary watercraft relative to a host vessel, as defined in claim 1, wherein said hinge block block support means includes a hinge block structure fixed to said deck, and adjacent portions of the hinge block structure and of said hinged beam section include companion hinged pintle formations to be interfitted with each other and receive a hinge pin therethrough supported along said pivot axis and maintained perpendicular to said inclined plane defined by the associated hinged beam section and stationary skid beam section.

4. Apparatus for recovery and launch of secondary watercraft relative to a host vessel, as defined in claim 2, wherein said hinge block support means includes a hinge block structure fixed to said deck, and adjacent portions of the hinge block structure and of said hinged beam section include companion hinged pintle formations to be interfitted with each other and receive a hinge pin therethrough supported along said pivot axis and maintained perpendicular to said inclined plane defined by the associated hinged beam section and stationary skid beam section.

5. Apparatus for recovery and launch of secondary watercraft relative to a host vessel, as defined in claim 1, including a trolley associated with each of said skid beam assemblies supported and guided for rectilinear reciprocative movement along the skid surfaces of the associated stationary skid beam section and hinged beam section, the trolleys having means for connection with the secondary watercraft for movement of the secondary watercraft with said trolleys, and powered means for hauling said trolleys up their associated skid surfaces defined by the skid beam assemblies to a raised position near the uppermost end of the associated skid beam assembly and for lowering the trolleys along said skid surfaces to positions adjacent the outermost tip ends of the hinged beam sections for lowering the secondary watercraft into the water.

6. Apparatus for recovery and launch of secondary watercraft relative to a host vessel, as defined in claim 2, including a trolley associated with each of said skid beam assemblies supported and guided for rectilinear reciprocative movement along the skid surfaces of the associated stationary skid beam section and hinged beam section, the trolleys having means for connection with the secondary watercraft for movement of the secondary watercraft with said trolleys, and powered means for hauling said trolleys up there associated skid surfaces defined by the skid beam assemblies to a raised position near the uppermost end of the associated skid beam assembly and for lowering the trolleys along said skid surfaces to positions adjacent the outermost tip ends of the hinged beam sections for lowering the secondary watercraft into the water.

7. Apparatus for recovery and launch of secondary water craft relative to a host vessel, as defined in claim 3, including a trolley associated with each of said skid beam assemblies supported and guided for rectilinear reciprocative movement along the skid surfaces of the associated stationary skid beam section and hinged beam section, the trolleys having means for connection with the secondary watercraft for movement of the secondary watercraft with said trolleys, and powered means for hauling said trolleys up there associated skid surfaces defined by the skid beam assemblies to a raised position near the uppermost end of the associated skid beam assembly and for lowering the trolleys along said skid surfaces to positions adjacent the outermost tip ends of the hinged beam sections for lowering the secondary watercraft into the water.

8. Apparatus for recovery and launch of secondary watercraft relative to a host vessel, as defined in claim 4, including a trolley associated with each of said skid beam assemblies supported and guided for rectilinear reciprocative movement along the skid surfaces of the associated stationary skid beam section and hinged beam section, the trolleys having means for connection with the secondary watercraft for movement of the secondary watercraft with said trolleys, and powered means for hauling said trolleys up there associated skid surfaces defined by the skid beam assemblies to a raised position near the uppermost end of the associated skid beam assembly and for lowering the trolleys along said skid surfaces to positions adjacent the outermost tip ends of the hinged beam sections for lowering the secondary watercraft into the water.

9. Apparatus for recovery and launch of secondary watercraft relative to a host vessel, as defined in claim 5, wherein said skid surfaces are covered with a layer of plastic friction-reducing material and said trolleys include trolley pad formations sliding on said friction-reducing material on said skid surfaces and including means for transferring sideloads from the trolley to the skid beam sections and hinged beam sections.

10. Apparatus for recovery and launch of secondary watercraft relative to a host vessel, as defined in claim 6, wherein said skid surfaces are covered with a layer of plastic friction-reducing material and said trolleys include trolley pad formations sliding on said friction-reducing material on said skid surfaces and including means for transferring sideloads from the trolley to the skid beam sections and hinged beam sections.

11. Apparatus for recovery and launch of secondary watercraft relative to a host vessel, as defined in claim 7, wherein said skid surfaces are covered with a layer of plastic friction-reducing material and said trolleys include trolley pad formations sliding on said friction-reducing material on said skid surfaces and including means for transferring sideloads from the trolley to the skid beam sections and hinged beam sections.

12. Apparatus for recovery and launch of secondary watercraft relative to a host vessel, as defined in claim 8, wherein said skid surfaces are covered with a layer of plastic friction-reducing material and said trolleys include trolley pad formations sliding on said friction-reducing material on said skid surfaces and including means for transferring sideloads from the trolley to the skid beam sections and hinged beam sections.

13. Apparatus for recovery and launch of secondary watercraft relative to a host vessel, as defined in claim 5, wherein said powered means comprises hydraulically powered linear pullers for each of said skid assemblies located adjacent the uppermost portions of said stationary skid beam sections connected by cable means to the associated trolley for communicating motive force from the pullers to the trolleys for recovery and launch of the secondary watercraft.

14. Apparatus for recovery and launch of secondary watercraft relative to a host vessel, as defined in claim 6, wherein said powered means comprises hydraulically powered linear pullers for each of said skid assemblies located adjacent the uppermost portions of said stationary skid beam sections connected by cable means to the associated trolley for communicating motive force from the pullers to the trolleys for recovery and launch of the secondary watercraft.

15. Apparatus for recovery and launch of secondary watercraft relative to a host vessel, as defined in claim 7, wherein said powered means comprises hydraulically powered linear pullers for each of said skid assemblies located adjacent the uppermost portions of said stationary skid beam sections connected by cable means to the associated trolley for communicating motive force from the pullers to the trolleys for recovery and launch of the secondary watercraft.

16. Apparatus for recovery and launch of secondary watercraft relative to a host vessel, as defined in claim 8, wherein said powered means comprises hydraulically powered linear pullers for each of said skid assemblies located adjacent the uppermost portions of said stationary skid beam sections connected by cable means to the associated trolley for communicating motive force from the pullers to the trolleys for recovery and launch of the secondary watercraft.

17. A method for transporting, recovery and launch of secondary watercraft such as single anchor leg mooring bases, barges, and the like, onto and from the deck of a host ship a pair of inclined skid beam assemblies extending transversely of a longitudinal axis of a host ship defining a pair of parallel skid paths spaced apart longitudinally of the ship, each skid beam assembly comprising a stationary skid beam section surmounted above the deck and having a substantially rectilinear skid surface spanning a major portion of the width of the deck and extending in an inclined plane relative thereto declining laterally toward a side of the ship, supporting a hinged beam at an end of each stationary skid beam section adjacent a lateral margin of the deck for swivel movement about a pivot axis maintained perpendicular to said inclined plane, positioning the hinged beams substantially parallel to the host ship longitudinal axis and perpendicular to the associated stationary skid beam when the secondary watercraft is stored for transport positioned on the stationary skid beam sections, swinging said hinged skid beams to an outboard launch and retrieval position disposed aligned with its associated stationary skid beam section as an aligned extension of its skid path to project at predetermined distance laterally outboard of the adjacent side of the host ship, and applying powered force to the secondary watercraft to move the same downwardly along said skid paths to launch the watercraft and to haul the watercraft upwardly along said skid paths to retrieve same.

* * * * *